United States Patent [19]

Stefan

[11] Patent Number: 4,550,787

[45] Date of Patent: Nov. 5, 1985

[54] EARTH BORING MACHINE AND WORKING CRANE

[76] Inventor: Alexander Stefan, 4680 W. Russell Rd., Las Vegas, Nev. 89118

[21] Appl. No.: 510,746

[22] Filed: Jul. 5, 1983

[51] Int. Cl.[4] ..... E21B 41/00

[52] U.S. Cl. ..... 175/88; 175/207; 299/66

[58] Field of Search ..... 175/88, 207; 299/25, 299/41, 52, 54, 70, 66, 76, 77, 73, 74, 63; 212/201, 204, 226, 227, 246, 252, 253, 254, 230, 231, 267, 269; 37/83, 86, 190, 191 R, 192 R, 192 A, 89

[56] References Cited

U.S. PATENT DOCUMENTS 1,783,443 12/1930 Morgan ..... 299/66
3,480,109 11/1969 Eitel et al. ..... 212/267
3,708,937 1/1973 Sterner ..... 212/269

FOREIGN PATENT DOCUMENTS 1174033 7/1964 Fed. Rep. of Germany ..... 212/204

*Primary Examiner*—Stephen J. Novosad
*Assistant Examiner*—Thuy M. Bui

[57] ABSTRACT

This invention is a machine assembly, including a post, an earth excavating machine and a crane interchangeably mountable on the post; the earth excavating machine including a sleeve enclosure around the post, a radially extending ground surface toothed scraper attached to the enclosure, a vertical screw inside the enclosure, and a loose earth conveyor belt extending from the sleeve, and the crane including a horizontal arm, a structure that rotates or elevates the arm and a cable assembly that suspends the arm adjustably from the post.

7 Claims, 10 Drawing Figures

EARTH BORING MACHINE AND WORKING CRANE

This invention relates generally to machinery used for the construction of cylindrical underground structures. More specifically, it relates to machinery that excavates the earth for such structures, and also machinery used for the constructing of underground structures.

It is well known that, until modern times, while labor was still relatively cheap, there was not much attention given to efficiency in the building of various underground structures, such as cylindrical wells, storage bins, mining shafts, silos, tanks, underground homes, and the like. However, today, with production costs continually rising, the efficiency of such construction is increasingly more important, especially since more of such underground construction is being done, in view of the ever-increasing uses of the land for modern production, scientific, military and other technologies.

Accordingly, it is a principal object of the present invention to provide a machine assembly for boring an opening into earth, and then building a cylindrical underground construction therein; and performing this work efficiently, so as to save on time and labor.

Another object is to provide a machine assembly that includes a boring machine and also a working crane, which are interchangeably installed upon a base unit for selectively doing the two different tasks, and which are quickly and easily mounted thereupon and dismantled therefrom.

Yet a further object is to provide an earth boring machine and working crane assembly, which may be made in any size, in order to be suitable for smaller or larger installations.

Other objects are to provide an earth boring machine and working crane, which is simple in design, inexpensive to manufacture, rugged in construction, easy to use, and efficient in operation.

These, and other objects, will be readily evident, upon a study of the following specification, and the accompanying drawing, wherein.

Figure 5:
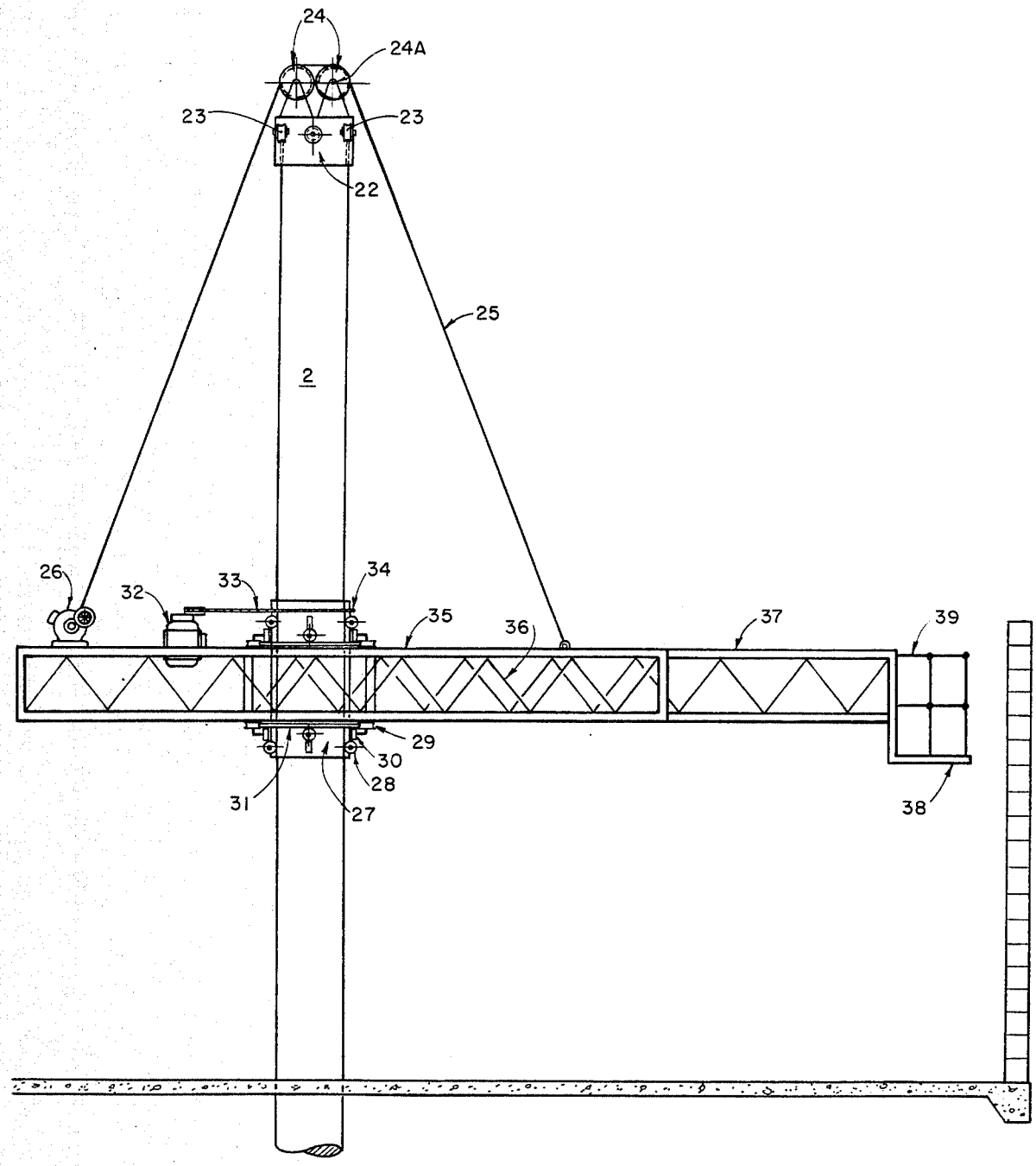
FIG. 5 is a diagrammatic side view of the crane portion of the present invention.

Referring now to the drawings in greater detail, there is shown a machine assembly, that includes an earth boring machine (as illustrated in FIG. 5), and which are selectively installed upon a post 2, made from a strong steel tubular pipe that is anchored vertically, by suitable machinery, into the ground, and leaving an upper end of the post to protrude aboveground.

The earth boring machine consists of two units; a first of which rotates around the post 2, and a second of which does not rotate therearound. However, both units are vertically slidable along the post. When installing the earth boring machine on the post, the rotatable unit is slid down first on the post, and the non-rotatable unit is then slid down on top of this. The rotatable unit is made of the components 3, 4, 11, 12, 13, 15, 17, 18, 20 and 21. The non-rotatable unit is made of the components 5, 7, 9, and 10.

The component 3 is a conical lower sleeve, that tapers downwardly, so as to penetrate easily into the ground, as it rotates around the post. The sleeve is hollow, and surrounds a lower portion of a screw 4. The screw may be manufactured by means of a spiralled screw thread being welded or formed around a tubular collar, through which the post extends. A component 5 of the non-rotatable unit is an inverted, hollow, bell-shaped upper sleeve, which, together with the lower sleeve 3, forms an enclosuse for the screw therewithin. The earth penetrating sleeve 3 has an opening 6, for receiving loose dirt, that is then carried upwardly on the screw, to a discharge opening 7 on the upper sleeve 5.

Figure 2:
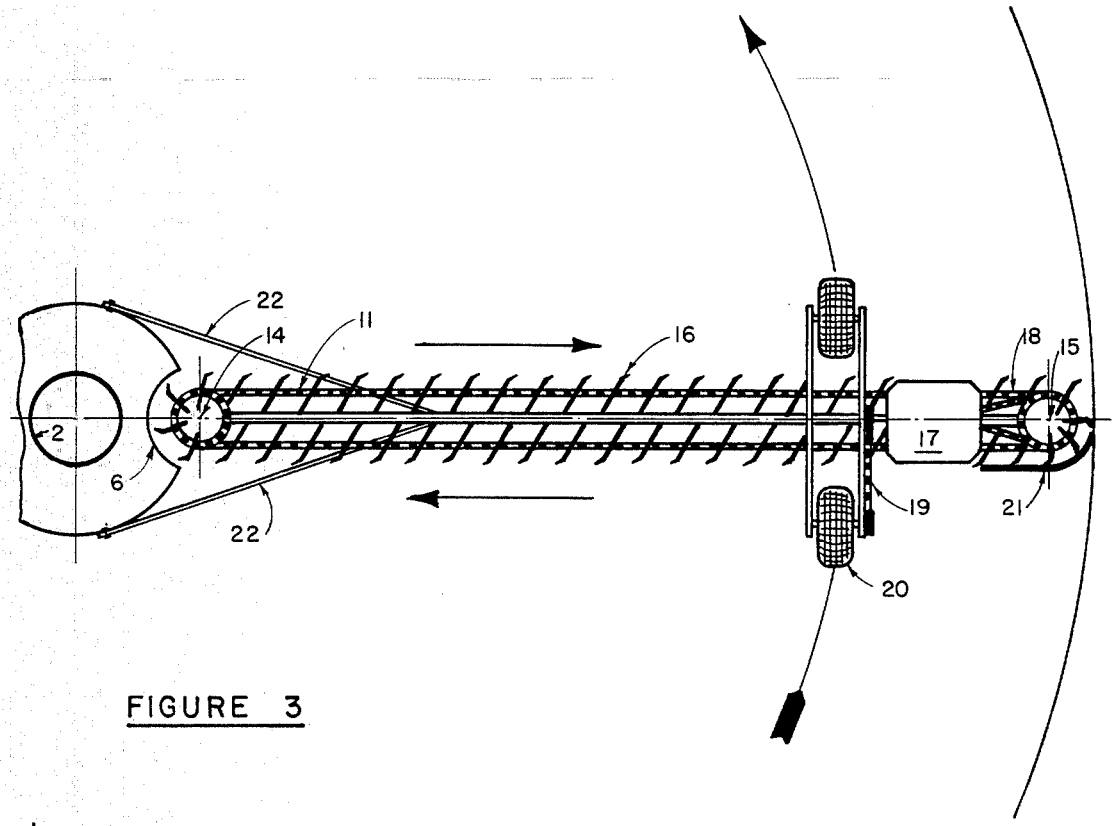
FIG. 2 is an enlarged diagrammatic top plan view of FIG. 1, shown fragmentary.
Figure 3:
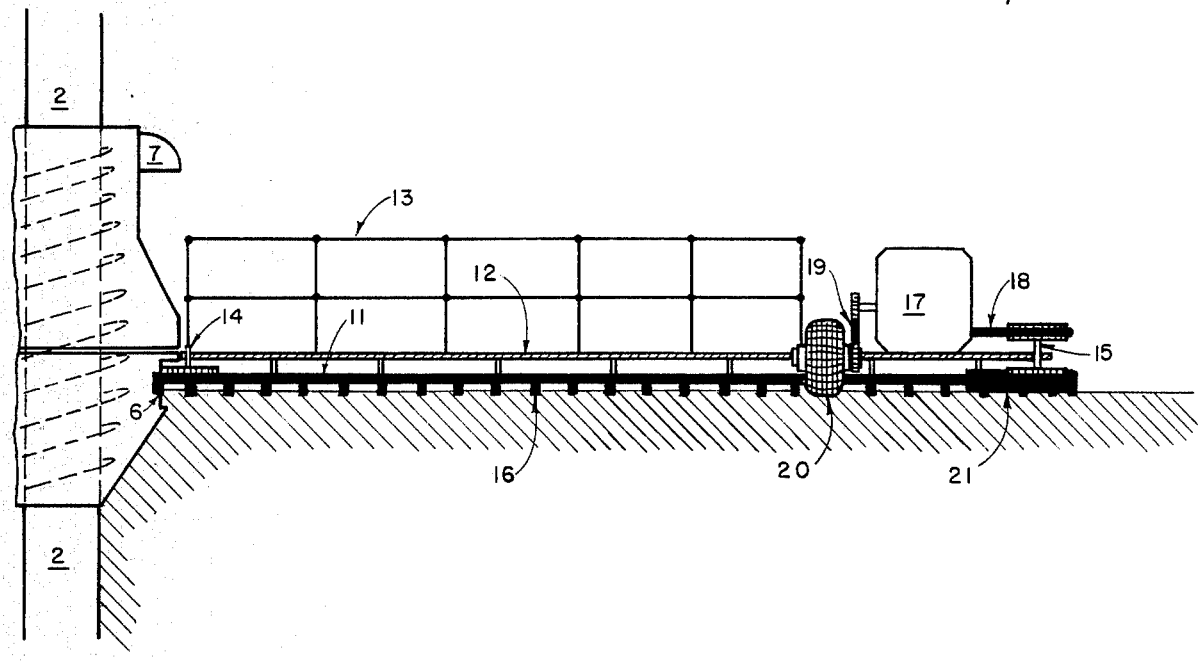
FIG. 3 is an enlarged fragmentary view of FIG. 1.
Figure 4:
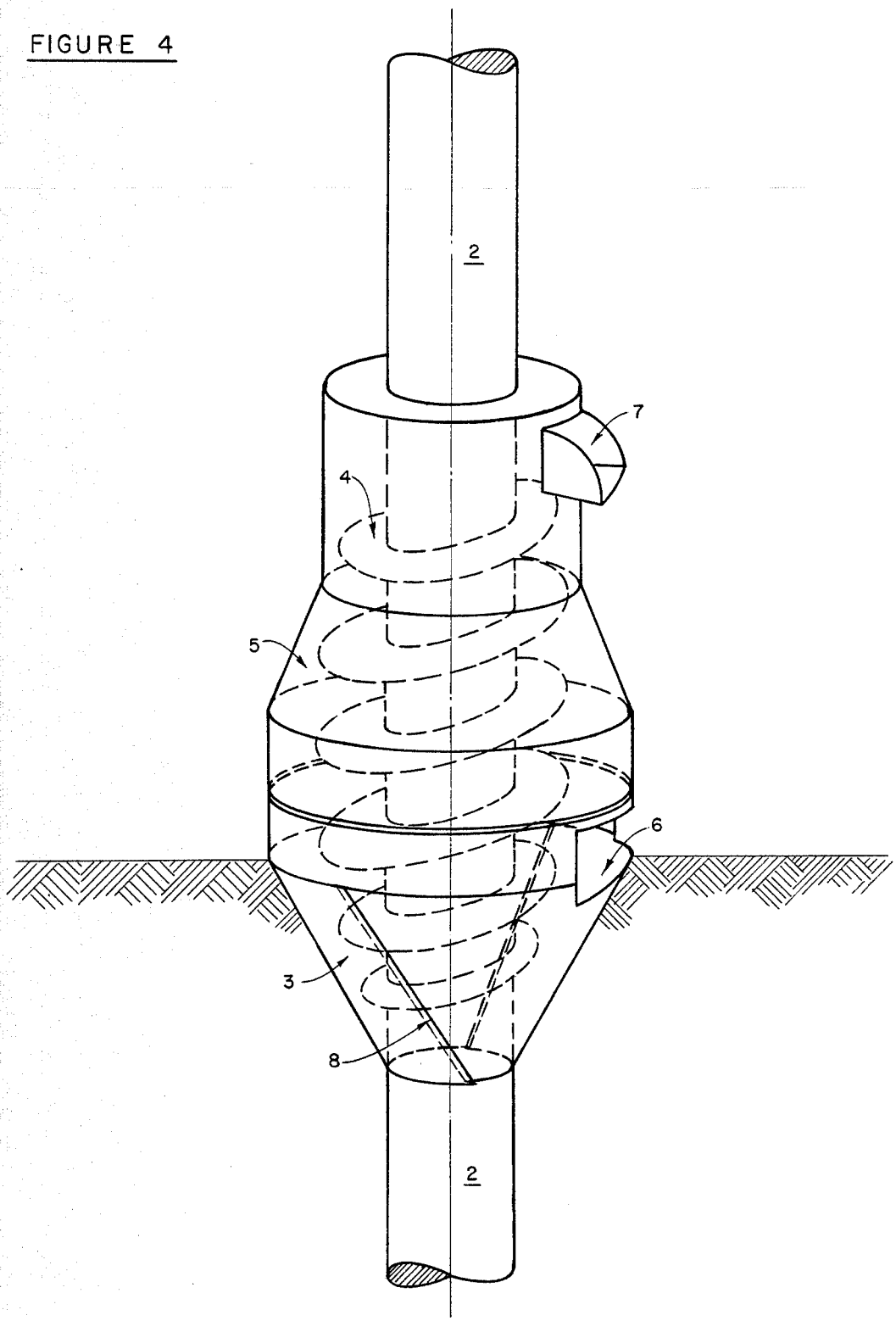
FIG. 4 is an enlarged perspective view of the earth penetrating center sleeve assembly of the boring machine.

An elongated chain frame 16 is secured at its one end, to the sleeve 3, by means of a pair of side bars 22, the chain frame extending horizontally in a radially outward direction from the sleeve. The outward end of the frame is supported upon a pair of wide wheels 20, fitted with pneumatic, rubber tires. A power plant 17 is mounted upon the frame, and, by means of a chain drive assembly 19, provides power to the wheels 20 to rotate. Sprockets 14 and 15 are supported rotatably free on opposite ends of the frame, and an endless chain 11 extends around the two sprockets, the chain carrying a plurality of equally spaced-apart blade-like teeth, for digging the earth. As shown in FIG. 2, the teeth are angled and the terminal outward ends thereof are additionally bent, in order to cut a side wall of a hole being dug into the ground, while a lower edge of the teeth scrape the top surface of the ground for cutting the bottom of the hole. The chain thus forms an elongated loop, wherein the inward end thereof extends into the intake opening 6 of the sleeve. The chain is powered to travel around the two sprockets by means of the sprocket 15 being turned by a drive assembly 18, that is also powered from the power plant 17, the chain traveling in a clockwise direction, as indicated by the two parallel arrows in FIG. 2, while the wheels 20 rotate the chain frame and the lower sleeve around the post 2, as indicated by the arcuate arrow in FIG. 2. One elongated side of the chain loop, indicated by the arrow pointing toward a right forms a chain run, whose teeth dig the ground surface, so as to form loose dirt and earth that is then moved into the interior of the chain loop, from where it is then moved toward the sleeve intake opening 6 by means of the teeth of the other chain run, indicated by the arrow pointing toward a left. A shield 21, shown fragmentarily in FIGS. 2 and 3, extends a full length alongside the last said chain run, so as to retain the loosened earth against this chain run, which pushes it into the inlet opening 6.

A catwalk 12, on top of the chain frame 16, and side hand rails 13 alongside thereof, permit workmen to walk out to the power plant, or do other inspection or maintenance work along the chain.

In operative use, it is now evident that, as the earth boring machine is powered by the power plant 17, the weight of the chain frame, and the equipment carried thereupon, cause it to scrape away a narrow layer of the earth, so that successive rotations thereof cause it to dig a deeper hole, as needed. The loosened earth is carried into the sleeve, where it is deposited upon a lower end of the screw. The loosened earth is then carried upwardly on the screw to the discharged opening 7, and outward upon a conveyor belt assembly 9.

It is to be noted that, as the hole is being dug deeper, the chain frame works at gradually lowering levels of the hole bottom, the chain frame thus causing the lower sleeve to dig into the ground, and lowering the upper sleeve, which rests upon the top of the screw.

Figure 1:
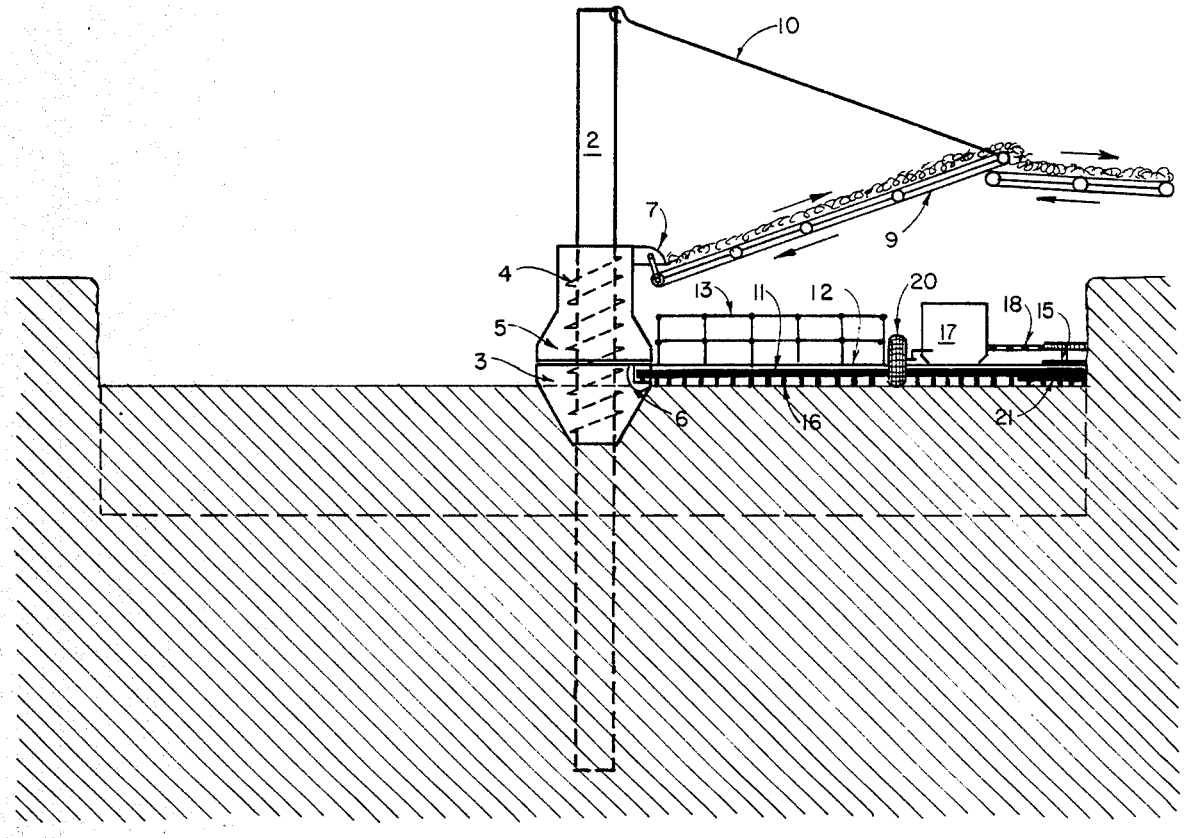
FIG. 1 is a diagrammatic side view of the earth boring machine of the present invention.
Figure 9:
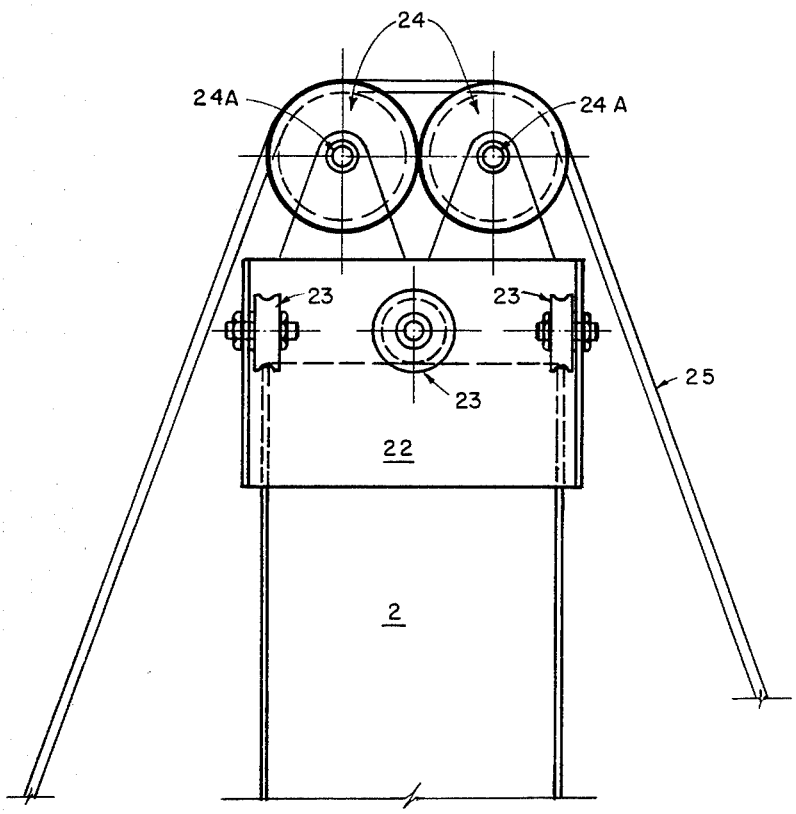
FIG. 9 is a side elevational view of FIG. 8.
Figure 10:
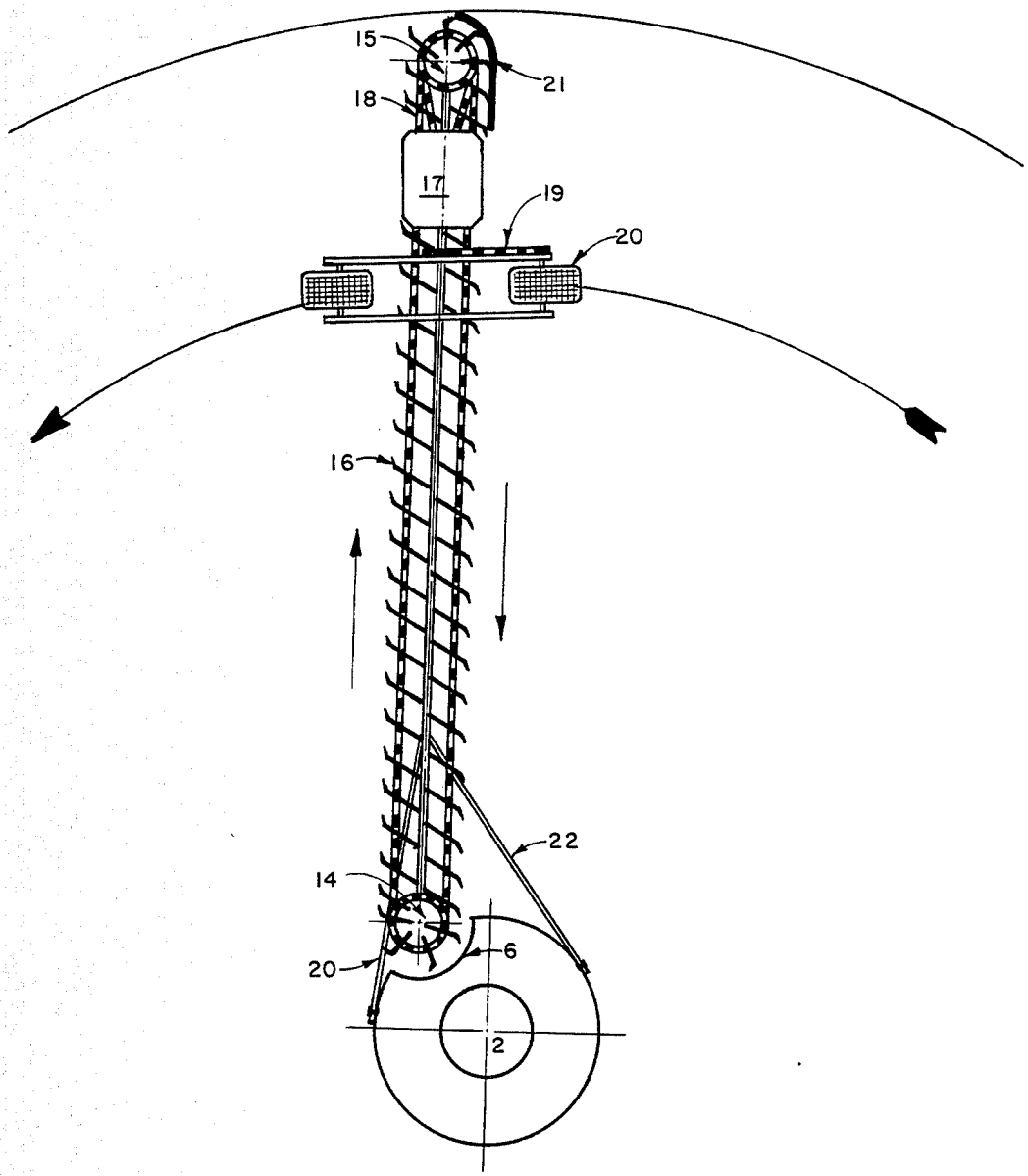
FIG. 10 shows the chain frame being forwardly angled, and forming an acute corner at the sleeve.

The conveyor belt assembly is pivotally supported at its inward end of the sleeve, while its outward end is suspended by a cable 10 from an upper end of the post. It is to be noted that the attachment of the cable to the post, as illustrated in FIG. 1, is diagrammatic only, and that, in an actual construction such attachment would include rotation means, possibly such as is shown in FIG. 9, in order to prevent winding up the cable around the post, as the sleeve and chain frame rotate therearound.

The conveyor belt assembly includes a plurality of rollers, around which an endless belt travels, carrying the loose earth, which then drops off the outward end of the conveyor assembly. The belt is powered to move by means of a motor (not shown), and which is mounted on the conveyor belt frame.

In a slightly modified design of the above indicated construction, the chain frame may be made to extend angularly more forwardly, instead of extending radially outward directly at right angles from the sleeve, so that an acute corner is thus formed on a front side of the chain frame, in the vicinity of the sleeve inlet 6, thereby aiding to move the loose earth into the inlet, as the chain frame travels around the post.

After the hole is thus excavated to a desired depth. the excavating machine is lifted off the post, and the post is now ready for an operating crane to be mounted thereupon, and which serves in the construction of an underground structure in the excavated hole.

Figure 7:
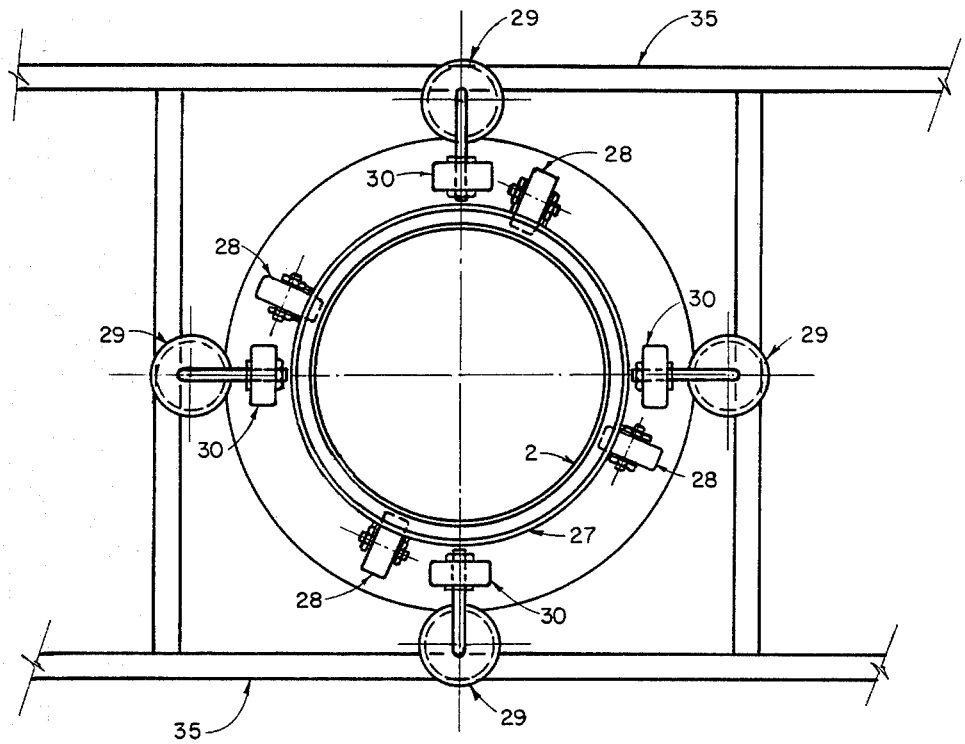
FIG. 7 is a top plan view of FIG. 6.
Figure 8:
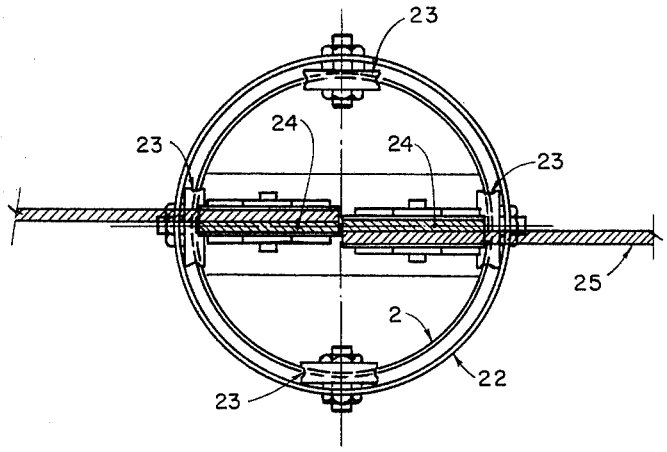
FIG. 8 is a top plan view of the top sleeve of the crane unit.

The operating crane, as shown in FIG. 5, includes a horizontal main arm 35, that is supported from the post, and which may be selectively raised or lowered as well as being directionally rotated, as needed, during the construction. The main arm comprises a framework of strong steel beams, held rigidly together by diagonally crossing braces 36 therebetween. The main arm is installed around the post by fitting the post transversely through the center of the arm, as is shown in FIG. 7.

An arm extension 37 is mounted upon one end of the arm, the extension being made either telescopic or adjustable, so that a working platform 38, on its outward end, may be brought either closer or further from a side wall of the hole, or from a side wall of a structure that is being constructed inside the hole, as shown in FIG. 5. The platform is adjustable in width, in order to accommodate more or less workmen and building materials placed thereupon. Handrails 39, on rear and opposite side ends of the platform, provide safety for workmen from falling off. The variably increased or decreased weight upon the platform would normally cause the arm to tilt from a horizontal position. However, in the present invention, this is solved by a strong structure, shown in FIGS. 6 and 7, which is supported from the post, and which, in turn, supports the main arm.

Figure 6:
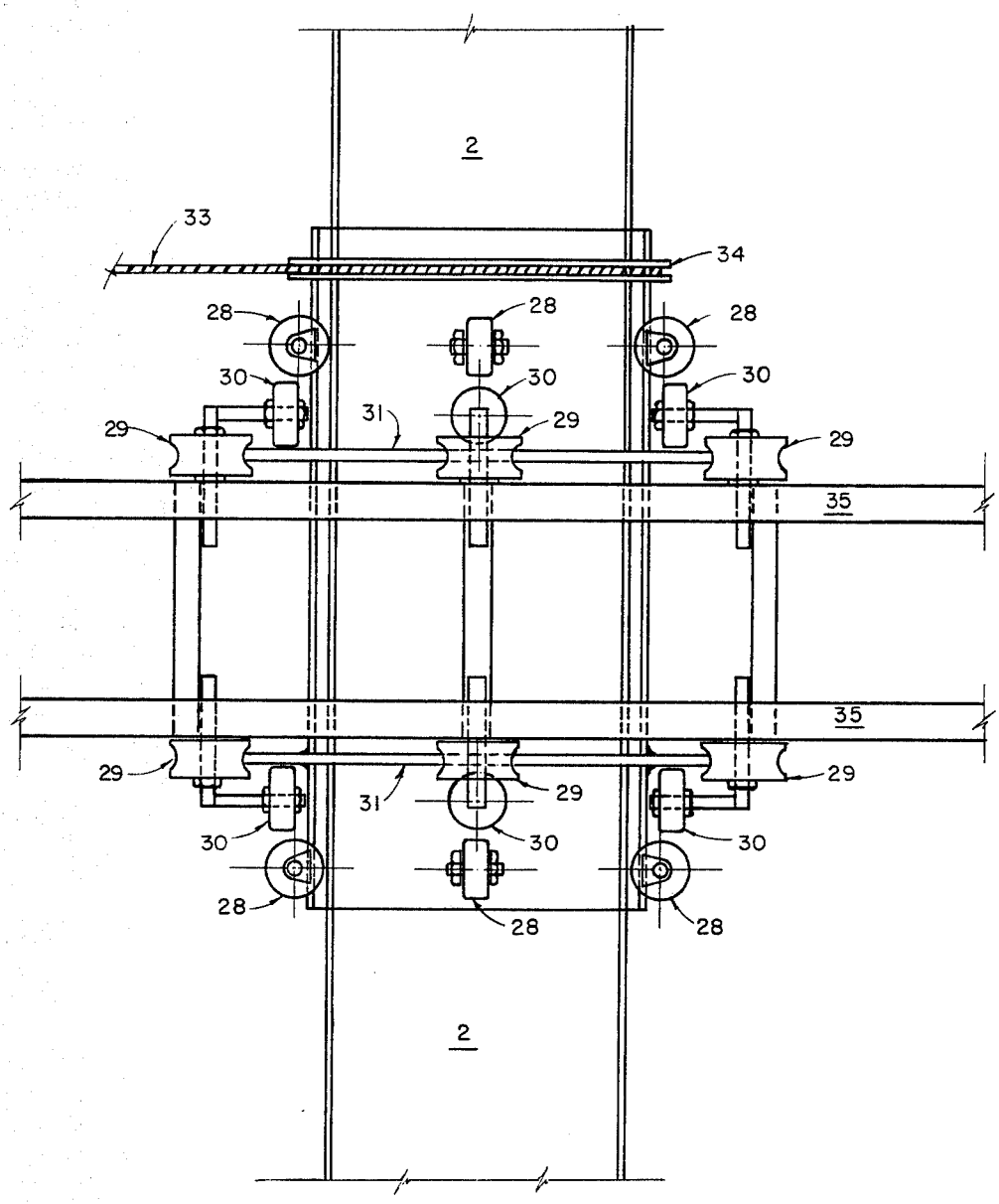
FIG. 6 is an enlarged side elevational view of the main sleeve of the crane portion of the invention.

This structure includes an elongated collar 27, that is vertically slidable around the post, while being arrested from rotation therearound by some form of locking means. A set of rollers 28 are mounted around an upper end, and also around a lower end of the collar, so as to travel up and down against the side of the post. An outwardly extending, circular flange 31 is formed around an upper and also around a lower part of the collar, each flange being supported rotatably free inside a center of a circle of rollers 29 therearound, that are mounted rotatably free on the main arm 35. Each roller 29 has an annular groove, in which the peripheral edge of the flange is held from slipping out, even if a great weight at one end of the arm stresses the arm to become tilted and displaced from its right angle position respective to the vertical post. Each roller 29 rotates on a vertical extending pin welded to the arm. For additional support against this stress trying to displace the arm, an additional set of rollers 30 bear directly against the side face of each of the flanges, so that the rollers 30 are at right angles to the roller 29, the rollers 30 being mounted rotatably free on right angle extensions of the pins that support the rollers 29. As shown in FIG. 6, the upper flange of the sleeve is held downwardly by the roller 30 being thereabove, while the lower flange of the sleeve is held upwardly by the rollers 30 being therebeneath, so that the flanges and the collar 27 thereof are thus sandwiched between the upper and lower sets of rollers 30, thereby preventing excessive stress to dislodge the arm respective to the collar. Thus, the vertically slidable sleeve along the post, and the rollers 29 and 30 rotatable around the collar flanges, provide vertical and rotational adjustment of the main arm.

The main arm is supported from a cable assembly, as shown in FIG. 5, and which includes a short, circular collar 22, that is freely rotatable around the outer side of the post, and which is supported upon an upper end thereof by means of a plurality of rollers 23 located in a circle around an inner side of the collar, and which are supported rotatably free on pins secured through the side wall of the collar, the rollers each having an annular groove for fitting upon the upper edge of the post pipe and rolling thereupon.

A pair of brackets fixedly secured to the collar extend upwardly above the top of the collar, and each bracket supports a cross pin 24A, on which a pulley 24 is supported rotatably free. Each pulley is sufficiently wide so that a cable 25 can be wound one full turn around the pulley, and both pulleys are aligned respective to each other, so that the same cable thus winds around both of the pulleys. One end of the cable is rigidly affixed to an eyebolt located near one end of the arm, and the opposite end of the cable being affixed to a drum of a winch 26, mounted upon an opposite end of the arm. The cable can be wound up around the drum, or unwound therefrom, in order selectively to shorten or lengthen the unwound portion thereof, and thereby either raise or lower the arm, as wished.

If wished, brakes may be provided for the pulleys 24, so that, when the main arm is not being vertically shifted, the pulleys may be braked to prevent them from turning. Thus, the cable is prevented from being pulled through the pulleys by a heavy load tugging on one end of the cable, so that the cable thus serves to help holding up the arm in the horizontal position. The pulley annular grooves may additionally be knurlled, or cross-toothed, for additional frictional grasp.

In operative use of the working crane, the main arm may be raised or lowered by operating the winch 26, and if brakes are employed at the pulleys 24, they should first be released. The main arm may be rotated around the pipe 2 by means of a motor 32 mounted upon the arm, and which drives an endless chain 33, engaged around a sprocket 34, rigidly affixed around the non-rotatable collar 27. Thus, the platform may be selectively swung toward any position for working on the wall.

After the construction work no longer requires the crane, it is dismantled from the post, and the post is then pulled up out of the ground by suitable machinery. Holes (not shown) may be provided along a side of the post, for lifting hooks, or the like, being anchored therein for use during the post removal operation.

While various changes may be made in the detail construction, it is understood that such changes will be within the spirit and scope of the present invention, as is defined by the appended claims.

What I claim as new, is:

1. A machine assembly for, first, excavating a hole in the ground, and then constructing a structure therein, comprising, in combination, an earth boring machine, a working crane and a post mountable in the ground, for selectively mounting said earth boring machine or said working crane thereupon; said earth boring machine comprising a rotatable unit and a non-rotatable unit, said rotatable unit being under said non-rotatable unit; said rotatable unit including means to dig a circular ground surface around said post, and including means to raise upwardly loose earth taken from said hole; said rotatable unit comprising an upwardly flared lower sleeve surrounding a lower portion of a spiralled screw welded around a tubular collar through which said post extends, an opening on a side of said sleeve, a radially extending, horizontal chain frame secured at one end to said sleeve adjacent said sleeve opening, an endless chain rotated on said frame, and a plurality of earth-digging teeth along said chain, said chain frame being forwardly angled, and forming an acute corner at said sleeve opening, for aiding loosened, dug earth to enter said opening for being raised up said spiral screw.

2. The combination as set forth in claim 1, wherein said non-rotatable unit includes conveyor means to discharge said loose earth outside of an edge of said excavated hole.

3. The combination as set forth in claim 2, wherein said working crane comprises a horizontal main arm, a structure between said post and said horizontal main arm, said structure having rotation and vertical movement means for said main arm, and a cable assembly for supporting said main arm on said post.

4. The combination as set forth in claim 3, wherein an extendible arm extension is mounted on one end of said main arm, and an outward end of said arm extension has a working platform.

5. The combination as set forth in claim 4, wherein power means are mounted upon said main arm for rotation and vertical elevation of said main arm relative to said post.

6. The combination as set forth in claim 5, wherein said working platform of said crane is adjustable in size.

7. The combination as set forth in claim 6, wherein said post comprises a tubular metal pipe.

* * * * *